US008499751B2

(12) United States Patent
Idogawa et al.

(10) Patent No.: US 8,499,751 B2
(45) Date of Patent: Aug. 6, 2013

(54) INTERNAL COMBUSTION ENGINE IGNITION COIL DEVICE

(75) Inventors: Takashi Idogawa, Chiyoda-ku (JP); Takeshi Shimizu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 217 days.

(21) Appl. No.: 13/172,283

(22) Filed: Jun. 29, 2011

(65) Prior Publication Data

US 2012/0222660 A1 Sep. 6, 2012

(30) Foreign Application Priority Data

Mar. 4, 2011 (JP) ..... 2011-047533

(51) Int. Cl.
*H01F 38/12* (2006.01)
*H01F 27/02* (2006.01)
*H01F 27/00* (2006.01)

(52) U.S. Cl.
USPC ..... 123/634; 336/90; 336/100

(58) Field of Classification Search
USPC ..... 123/634, 621, 169 R, 179.4; 336/90, 336/96, 100, 105, 107
See application file for complete search history.

(56) References Cited

U.S. PATENT DOCUMENTS

| | | | | |
|---|---|---|---|---|
| 4,453,526 | A * | 6/1984 | Ito et al. | 123/617 |
| 5,875,543 | A * | 3/1999 | Fujimoto et al. | 29/618 |
| 6,639,498 | B2 * | 10/2003 | Shimada et al. | 336/96 |
| 6,799,451 | B2 * | 10/2004 | Kiess et al. | 73/35.07 |
| 7,036,495 | B1 * | 5/2006 | Shimizu | 123/633 |
| 7,213,588 | B2 * | 5/2007 | Iwa et al. | 123/633 |
| 2007/0181109 | A1 * | 8/2007 | Matsui et al. | 123/634 |

FOREIGN PATENT DOCUMENTS

| | | | |
|---|---|---|---|
| JP | 2004-232466 | A | 8/2004 |
| JP | 4209400 | B2 | 10/2006 |
| JP | 2008-25495 | A | 2/2008 |

* cited by examiner

*Primary Examiner* — Stephen K Cronin
*Assistant Examiner* — Pedro Gomez
(74) *Attorney, Agent, or Firm* — Sughrue Mion, PLLC

(57) ABSTRACT

An ignition coil device according to the present invention is provided with a primary coil to which a primary current is applied; a secondary coil that is magnetically coupled with the primary coil and generates an ignition voltage when the primary current is cut off, so as to produce a spark discharge between a pair of electrodes of an ignition plug; a noise suppression element electrically connected between the secondary coil and one of the electrodes of the ignition plug; and a case made of an insulating material having a noise suppression element containing unit. The device is characterized by including ribs disposed in the noise suppression element containing unit and arranged in such a way as to face the outer circumferential surface of the noise suppression element and a resin insulating material that is filled into the containing unit and makes contact with the ribs and the noise suppression element.

5 Claims, 5 Drawing Sheets

INTERNAL COMBUSTION ENGINE IGNITION COIL DEVICE

BACKGROUND OF THE INVENTION

1. Field of the Invention

The present invention relates to an internal combustion engine ignition coil device that is provided, for example, in a vehicle internal combustion engine mounted on a vehicle such as an automobile and that supplies a high voltage to an ignition plug so as to produce a spark discharge.

2. Description of the Related Art

To date, an internal combustion engine has been configured in such a way that by a high voltage generated across an ignition coil, a large transient current is made to flow in an ignition plug so that a spark discharge is produced between the electrodes of the ignition plug and through the spark discharge, a fuel inside a combustion chamber of the internal combustion engine is ignited; however, there has been a problem that the spark discharge in the ignition plug generates an electric wave and the electric wave propagates into the surrounding space, thereby producing noise or the like in a radio receiver or the like.

Accordingly, to date, there has been commercialized an internal combustion engine ignition coil device in which in order to suppress noise caused by spark discharge, a noise suppression resistance element is connected in series between an ignition coil and an ignition plug and the resistance element is incorporated in the case of the ignition coil. With regard to such a conventional ignition coil device, there exist a case where a noise suppression resistance element is directly fixed to and is incorporated in the case of the ignition coil device (e.g., refer to Patent Documents 1 and 2) and a case where a noise suppression resistance element is supported by a spring unit for connecting an ignition coil and an ignition plug and is incorporated in the case of the ignition coil device (e.g., refer to Patent Document 3).

PRIOR ART REFERENCE

[Patent Document]

[Patent Document 1] Japanese Patent No. 4209400

[Patent Document 2] Japanese Patent Application Laid-Open No. 2004-232466

[Patent Document 3] Japanese Patent Application Laid-Open No. 2008-25495

Each of the conventional internal combustion engine ignition coil devices disclosed in Patent Documents 1 through 3 has a problem that the structure thereof is complex. In addition, in the conventional internal combustion engine ignition coil device disclosed in Patent Document 3, a spring unit supports a noise suppression resistance element and the spring unit and the noise suppression resistance element are electrically connected with each other; therefore, vibration of the internal combustion engine may cause a momentary electric interruption at a point where the spring unit and the resistance element are connected with each other, or because the noise suppression resistance element, which is a material having a weight, is disposed in the spring unit, a momentary electric interruption may be caused at a point where the ignition coil main body and the spring unit are electrically connected with each other or a point where the ignition plug and the spring unit are electrically connected with each other.

Furthermore, in each of the conventional internal combustion engine ignition coil devices disclosed in Patent Documents 1 and 2, because a noise suppression resistance element supported on the case of the ignition coil device is electrically connected with an ignition coil, by means of a (an electrode) cap embedded in a resin unit that is filled around the ignition coil, a thermal stress on the resin may cause a crack in the resin unit, and through the crack, an electric current may leak from a lead wire to the outside of the ignition coil device, thereby causing an external discharge, or through the crack caused in the resin unit, an electric current may leak from the (electrode) cap to the inside of the ignition coil device, thereby causing an internal discharge.

SUMMARY OF THE INVENTION

The present invention has been implemented in order to solve the foregoing problems in conventional internal combustion engine ignition coil devices; the objective thereof is to provide an internal combustion engine ignition coil device that can suppress a momentary electric interruption at a point where electric connection is made and an external discharge or an internal discharge.

An internal combustion engine ignition coil device according to the present invention is provided with a primary coil to which a primary current is applied; a secondary coil that is magnetically coupled with the primary coil and generates an ignition voltage when the primary current is cut off, so as to produce a spark discharge between a pair of electrodes of an ignition plug; a noise suppression element that is electrically connected between the secondary coil and one of the pair of electrodes of the ignition plug; and a case that is made of an insulating material and has a noise suppression element containing unit that contains the noise suppression element. The internal combustion engine ignition coil device is characterized by including a rib that is included in the noise suppression element containing unit and is disposed in such a way as to face the outer circumferential surface of the noise suppression element and a resin insulating material that is filled into the noise suppression element containing unit and makes contact with the rib and the noise suppression element.

The internal combustion engine ignition coil device according to the present invention is provided with the rib that is included in the noise suppression element containing unit of the case and is disposed in such a way as to face the outer circumferential surface of the noise suppression element and the resin insulating material that is filled into the noise suppression element containing unit and makes contact with the rib and the noise suppression element; therefore, even in the case where a vibration occurs in an internal combustion engine, no momentary electric interruption is caused, and even in the case where a crack is caused, any external discharge or any internal discharge can be suppressed.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
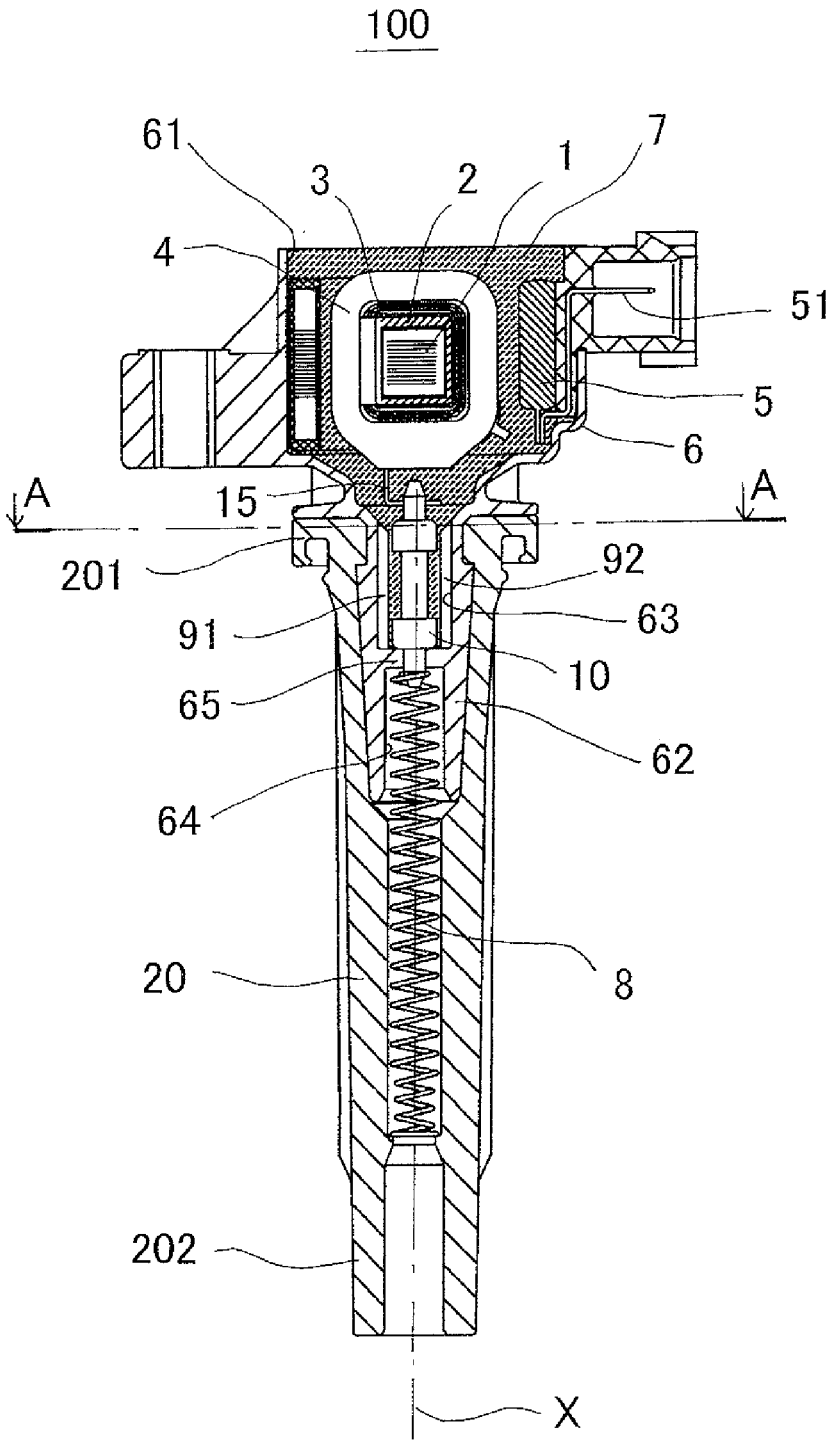
FIG. 1 is a longitudinal cross-sectional view of an internal combustion engine ignition coil device according to Embodiment 1 of the present invention.
Figure 2:
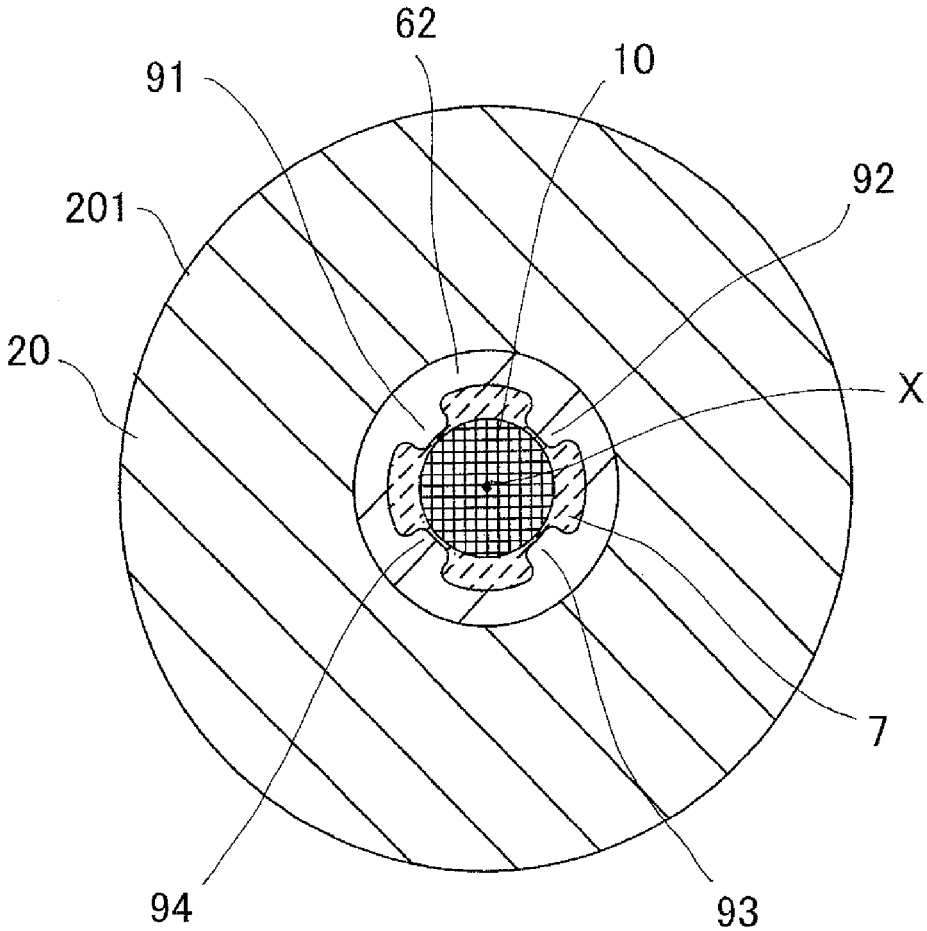
FIG. 2 is a transverse cross-sectional view of the internal combustion engine ignition coil device in FIG. 1 as viewed along the line A-A.

Hereinafter, an internal combustion engine ignition coil device according to Embodiment 1 of the present invention will be explained with reference to the drawings. FIG. 1 is a longitudinal cross-sectional view of an internal combustion engine ignition coil device according to Embodiment 1 of the present invention; FIG. 2 is a transverse cross-sectional view of the internal combustion engine ignition coil device in FIG. 1 as viewed along the line A-A. In each of FIGS. 1 and 2, an internal combustion engine ignition coil device 100 is provided with a primary coil 3 wound around an magnetic core 1 through the intermediary of a bobbin 2 and a secondary coil 4 wound around the primary coil 3. The primary coil 3 and the secondary coil 4 are magnetically coupled with each other through the intermediary of the magnetic core 1.

An igniter 5 connected with an unillustrated engine control unit (ECU) through the intermediary of a connection terminal 51 supplies or cuts off a primary current for the primary coil 3, in response to a drive signal from the engine control unit (ECU). The primary current flowing in the primary coil 3 is cut off; a high voltage is generated across the secondary coil 4; then, a spark discharge is produced between a pair of electrodes of an ignition plug (unillustrated) connected with the secondary coil 4. The spark discharge produced between the electrodes of the ignition plug ignites a fuel inside a cylinder of the internal combustion engine, so that the fuel burns.

The magnetic core 1, the bobbin 2, the primary coil 3, the secondary coil 4, and the igniter 5 are contained in a coil containing unit 61 of a case 6 made of an insulating material and fixed in the case 6 by means of a casting resin insulating material 7. The case 6 has a high voltage tower unit 62 that protrudes downward in FIG. 1 and serves as a cylindrical tower unit. The high voltage tower unit 62 is provided with a spring insertion unit 64 and a noise suppression element containing unit 63 formed continuously from the coil containing unit 61 of the case 6. The noise suppression element containing unit 63 and the spring insertion unit 64 are separated from each other by a diaphragm 65. One end of a spring 8, which is electrically connected with an ignition plug, is inserted into the spring insertion unit 64 of the high voltage tower unit 62.

On the inner circumferential surface of the noise suppression element containing unit 63, there are provided four ribs 91, 92, 93, and 94 formed by protrusions that extend in a direction, as a predetermined direction, in which the center axis X of the high voltage tower unit 62 extends, i.e., in which the center axis X of the noise suppression element containing unit 63 extends. These four ribs 91, 92, 93, and 94 are arranged around the center axis X of the high voltage tower unit 62 in such a way as to be spaced 90° apart from one another.

A noise suppression resistance element 10, which is a cylindrically formed noise suppression element, is contained in the noise suppression element containing unit 63 in such a way that the center axis thereof coincides with the center axis X of the noise suppression element containing unit 63. Accordingly, the noise suppression resistance element 10 is contained in the noise suppression element containing unit 63 in such a way that the center axis thereof X is elongated along the direction in which the four ribs 91, 92, 93, and 94 extend. As well illustrated in FIG. 2, the respective inner circumferential surfaces of the ribs 91, 92, 93, and 94 face the circumferential surface of the noise suppression resistance element 10, through a minute gap.

The noise suppression element containing unit 63 is filled with the casting resin insulating material 7 that is the same as the casting resin insulating material 7 filled into the coil containing unit 61 and solidified therein. The casting resin insulating material 7 tightly adheres to the outer circumferential surface of the noise suppression resistance element 10, the inner surface of the noise suppression element containing unit 63, and the respective inner circumferential surfaces of the ribs 91, 92, 93, and 94 so as to robustly fix the noise suppression resistance element 10 in the high voltage tower unit 62 of the case 6.

Figure 3:
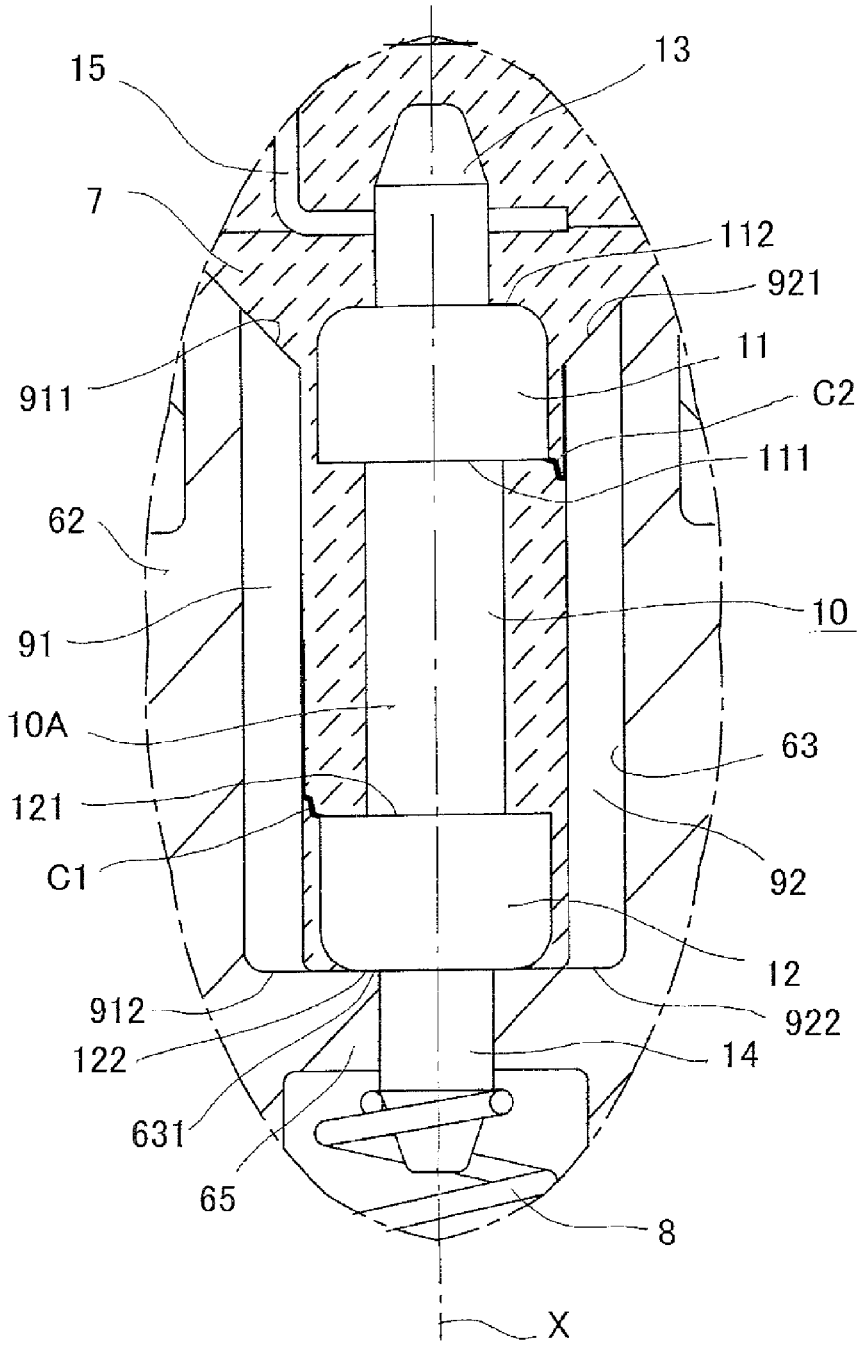
FIG. 3 is an explanatory view illustrating, in an enlarging manner, part of an internal combustion engine ignition coil device according to Embodiment 1 of the present invention.

FIG. 3 is an explanatory view illustrating, in an enlarging manner, part of an internal combustion engine ignition coil device according to Embodiment 1 of the present invention. As illustrated in FIG. 3, the noise suppression resistance element 10 is provided with a noise suppression resistance element main body 10A and first and second metal caps 11 and 12 that are attached to the respective end portions, in the direction of the center axis X, of the noise suppression resistance element main body 10A. The first cap 11 and the second cap 12 have edge portions 111 and 121, respectively, that face each other through the noise suppression resistance element main body 10A.

A metal protrusion 13 that extends along the direction of the center axis X of the noise suppression resistance element main body 10A is fixed to an end portion 112 that is opposed to the edge of the first cap 11. A metal protrusion 14 that extends along the direction of the center axis X of the noise suppression resistance element main body 10A is fixed to an end portion 122 that is opposed to the edge of the second cap 12.

As illustrated in FIG. 3, the end portion 112 that is opposed to the edge of the first cap 11 and the protrusion 13 are situated in the coil containing unit 61, and the protrusion 13 is electrically connected with the secondary coil 4 through the intermediary of a connecting conductor 15. The protrusion 14 and the end portion 122 that is opposed to the edge of the second cap 12 are situated in a space that is opposed to the coil containing unit; the protrusion 14 penetrates the diaphragm and is exposed inside the spring insertion unit 64; the protrusion 14 is electrically connected with the spring 8, and is further connected electrically with an ignition plug through the intermediary of the spring 8.

Edges 911 and 921, in the coil containing unit 61, of the ribs 91 and 92 are formed of respective slant surfaces and are situated in such a way as to face each other through the intermediary of the edge portion 111 of the first cap 11 of the noise suppression resistance element 10 and the end portion 112 that is opposed to the edge portion 111. Edges 912 and 922, in a space that is opposed to the coil containing unit 61, of the ribs 91 and 92 are coupled with the bottom surface 631 of the noise suppression element containing unit 63 and are situated in such a way as to be approximately opposed to the end portion 122, of the second cap 12, that is opposed to the edge portion thereof. In addition, although unillustrated, the edges, in the coil containing unit 61, of the ribs 93 and 94 and the edges, in a space that is opposed to the coil containing unit 61, of the ribs 93 and 94 are formed in the same manner as those of the ribs 91 and 92.

As illustrated in FIG. 1, a hollow plug boot 20 formed of an insulating material is attached to the high voltage tower unit 62 of the case 6 in an attachable and detachable manner. The inner circumferential surface of one end portion 201, in the direction of the center axis X, of the plug boot 20 adheres to the outer circumferential surface of the high voltage tower unit 62 of the case 6. The other end portion of the spring 8 whose one end portion is inserted into the spring insertion unit 64 of the high voltage tower unit 62 is inserted into the inner space of the plug boot 20. The terminal portion of an unillustrated ignition plug is inserted into the other end portion 202, in the direction of the center axis X, of the plug boot 20 so as to be electrically connected with the spring 8.

The internal combustion engine ignition coil device, according to Embodiment 1 of the present invention, configured in such a manner as described above is attached to an ignition plug in the foregoing manner and then is mounted in an internal combustion engine.

In the internal combustion engine ignition coil device according to Embodiment 1 of the present invention, the noise suppression resistance element 10 is fixed with the casting resin insulating material 7; therefore, even when a vibration is produced in the internal combustion engine, no momentary electricity interruption is caused. In the case where a stress is exerted on the case 6, for example, as illustrated in FIG. 3, cracks C1 and C2 are caused in thin-walled portions of the casting resin insulating material 7 that makes contact with the noise suppression resistance element 10; however, the cracks C1 and C2 extend no farther than the inner circumferential surfaces of the ribs 91 and 92, i.e., the surfaces, of the ribs 91 and 92, that face the circumferential surface of the noise suppression resistance element 10, whereby the insulation between the case 6 and the outside thereof can be maintained.

Any crack that originates in the noise suppression resistance element 10 is caused in a space between the noise suppression resistance element 10 and the inner circumferential surfaces of the ribs 91, 92, 93, and 94; furthermore, even in the case where separation in the casting resin insulating material 7 extends in the longitudinal direction of the rib, there can be ensured the insulation distance between the noise suppression resistance element 10 and other integrated components, for example, the secondary coil 4; therefore, neither external discharge nor internal discharge is caused.

Moreover, because the cracks C1 and C2 relax the stress exerted on the noise suppression resistance element 10, the noise suppression resistance element 10 is not broken; even in the case where separation extends along the rib 91, 92, 93, or 94, there can be ensured the insulation distance between the noise suppression resistance element 10 and other integrated components, for example, the secondary coil 4; therefore, no internal discharge is caused.

In the case where the noise suppression resistance element is integrated in the case 6, the ribs 91, 92, 93, and 94 function as guides for inserting the noise suppression resistance element 10 into the noise suppression element containing unit 63; thus, the integration can readily be implemented.

In Embodiment 1, there has been described a case where the igniter 5 is incorporated in the ignition coil device 100; however, the igniter 5 may be separated from the ignition coil device 100. Moreover, in Embodiment 1, there has been described an example of plug-top type where the ignition coil device 100 is mounted on a cylinder head of an internal combustion engine; however, there may be allowed a plug-hole type where the ignition coil device 100 is disposed inside a plug hole of an internal combustion engine.

Embodiment 2

Figure 4:
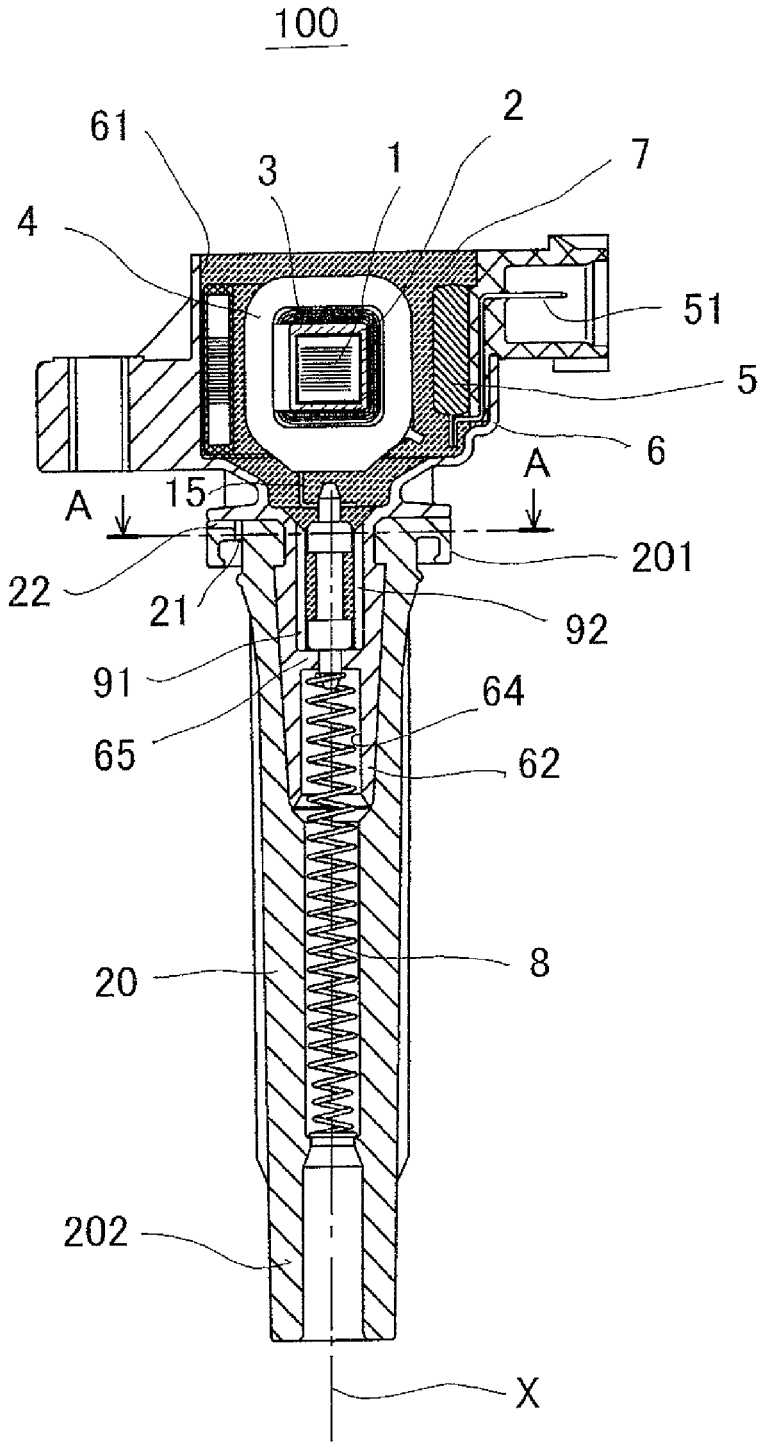
FIG. 4 is a longitudinal cross-sectional view of an internal combustion engine ignition coil device according to Embodiment 2 of the present invention.
Figure 5:
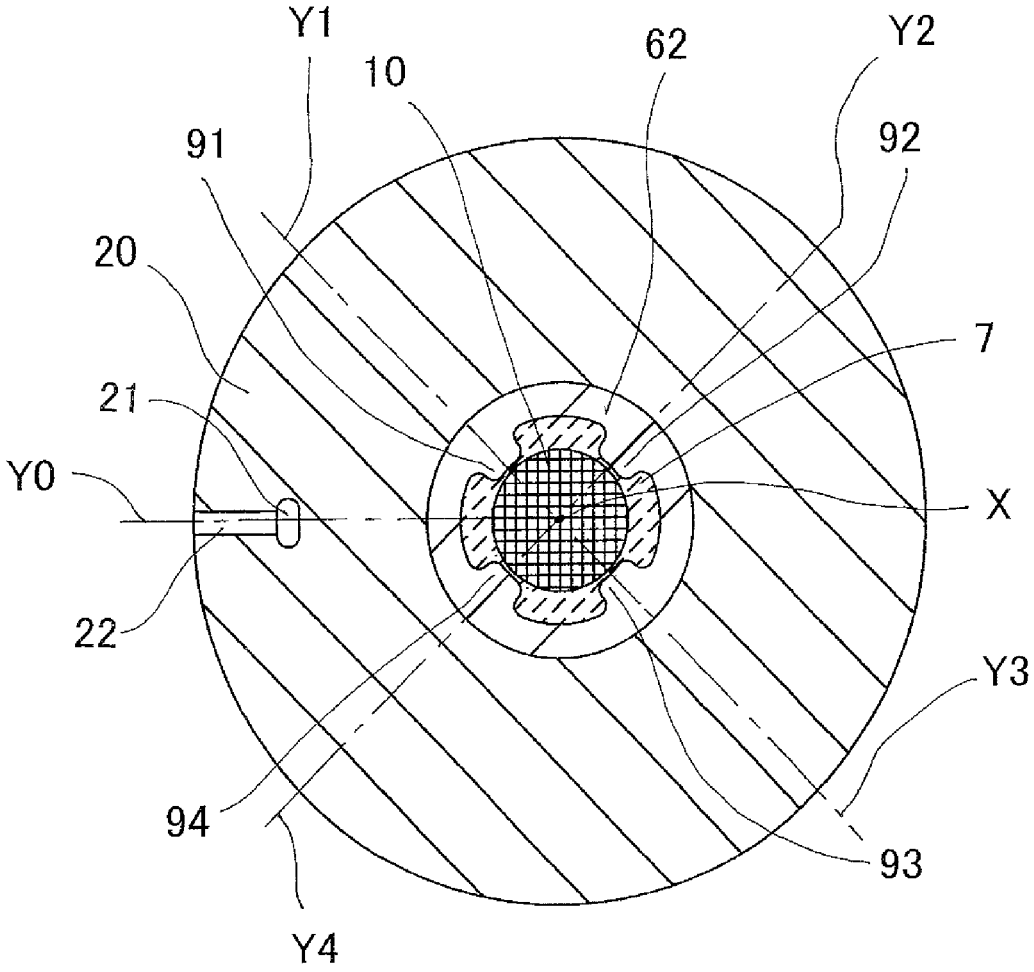
FIG. 5 is a transverse cross-sectional view of the internal combustion engine ignition coil device in FIG. 4 as viewed along the line A-A.

FIG. 4 is a longitudinal cross-sectional view of an internal combustion engine ignition coil device according to Embodiment 2 of the present invention; FIG. 5 is a transverse cross-sectional view of the internal combustion engine ignition coil device in FIG. 4 as viewed along the line A-A. In FIGS. and 5, the plug boot 20 attached to the high voltage tower unit 62 of the case 6 has a first air venting hole 21, at a place where the one end portion 201, in the direction of the center axis X, of the plug boot 20 and the case 6 make contact with each other, that extends in the direction of the center axis X of the plug boot 20 and penetrates the one end portion 201 of the plug boot; and a second air venting hole 22 that communicates with the top end portion of the first air venting hole 21, extends in the direction of the radius of the plug boot 20, and opens in the outer circumferential surface of the plug boot 20.

As well illustrated in FIG. 5, the first air venting hole and the second air venting hole 22 are formed at positions corresponding to a radial direction axis Y0 of the plug boot 20. The first air venting hole 21 and the second air venting hole 22 is to exhaust air remaining at a portion where the end face of the case 6 and the one end portion 201 of the plug boot 20 make contact with each other, when the plug boot 20 is inserted into the high voltage tower unit 62.

On the other hand, the ribs 91, 92, 93, and 94 are provided at respective positions corresponding to radial direction axes Y1, Y2, Y3, and Y4. In Embodiment 2, the radial direction axes Y1 and Y3 are on a single and the same line; the radial direction axes Y2 and Y4 are on a single and the same line. As described above, on the inner circumferential surface of the noise suppression element containing unit 63, the ribs 91, 92, 93, and 94 are formed at the positions corresponding to the radial direction axes Y1, Y2, Y3, and Y4, which are different from the radial direction axis Y0 along which there is formed an air venting hole configured with the first air venting hole 21 and the second air venting hole 22. The radial direction axes Y1, Y2, Y3, and Y4 are spaced 90° apart from one another; the radial direction axes Y0 and Y1 are spaced 45° apart from each other; the radial direction axes Y0 and Y4 are spaced 45° apart from each other.

The other configurations are the same as those in Embodiment 1.

In the foregoing internal combustion engine ignition coil device according to Embodiment 2 of the present invention, the first air venting hole 21, the second air venting hole 22, and the ribs 91, 92, 93, and 94 are formed at positions corresponding to different radial direction axes; therefore, even in the case where a crack is caused in a space between the noise suppression resistance element 10 and the inner circumferential surface of the rib 91, 92, 93, or 94, the path from the inner circumferential surface of the rib 91, 92, 93, or 94 to a cylinder head of the internal combustion engine by way of the air venting hole becomes long, whereby no external discharge is produced. In addition, the air venting holes and the ribs are formed at positions corresponding to the different radial direction axes; thus, even in the case where the diameter of the high voltage tower unit 62 is small, the insulation distance between the noise suppression resistance element 10 and the outside can be ensured. As a result, no external discharge is produced, whereby downsizing is feasible and the flexibility in laying out is enhanced.

The internal combustion engine ignition coil device according to Embodiment 2 of the present invention can demonstrate the same effect as that according to Embodiment 1.

Additionally, in Embodiment 2, four ribs 91, 92, 93, and 94 are formed, and the ribs 91 and 94 are each provided 45° apart from the first air venting hole 21 and the second air venting hole 22; however, the number of ribs is not limited to four. Moreover, the radial direction axis corresponding to the position at which the air venting holes are provided and the radial direction axis corresponding to the position at which the rib is provided may be spaced apart from each other by an angle other than 45°, for example, 50°.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine ignition coil device comprising:

a primary coil to which a primary current is applied;

a secondary coil that is magnetically coupled with the primary coil and generates an ignition voltage when the primary current is cut off, so as to produce a spark discharge between a pair of electrodes of an ignition plug;

a noise suppression element that is electrically connected between the secondary coil and one of the pair of electrodes of the ignition plug; and a case that is made of an insulating material and has a noise suppression element containing unit that contains the noise suppression element, wherein there are provided a rib that is included in the noise suppression element containing unit and is disposed in such a way as to face the outer circumferential surface of the noise suppression element and a resin insulating material that is filled into the noise suppression element containing unit and makes contact with the rib and the noise suppression element.

2. The internal combustion engine ignition coil device according to claim 1, wherein the rib is formed of a protrusion that extends in a predetermined direction, and the noise suppression element is cylindrically formed and is contained in the noise suppression element containing unit in such a way that the center axis thereof is elongated along a direction in which the rib extend.

3. The internal combustion engine ignition coil device according to claim 2, wherein there are provided two or more ribs, and the two or more ribs are arranged around the outer circumferential surface of the noise suppression element in such a way as to be spaced a predetermined angle apart from one another.

4. The internal combustion engine ignition coil device according to claim 3, wherein the noise suppression element is provided with a noise suppression element main body and first and second metal caps that are attached to the respective end portions, in the direction of the center axis, of the noise suppression element main body; the first cap and the second cap have respective edge portions that face each other through the noise suppression element main body; the end portion, of the first cap, that is opposed to the edge thereof is situated in a coil containing unit and is electrically connected with the secondary coil; the end portion, of the second cap, that is opposed to the edge thereof is situated in a space that is opposed to the coil containing unit and is electrically connected with the ignition plug; the edge, of the rib, in the coil containing unit is situated in such a way as to face an intermediate portion between the edge portion of the first cap and the end portion, of the first cap, that is opposed to the edge portion thereof; and the edge, of the rib, in a space that is opposed to the coil containing unit is situated in such a way as to approximately face the end portion, of the second cap, that is opposed to the edge portion thereof.

5. The internal combustion engine ignition coil device according to claim 1, wherein the case has a tower unit, to the outer circumferential surface of which a plug boot made of an insulating material is attached; the noise suppression element containing unit is provided inside the tower unit; the plug boot has an air venting hole for exhausting air between the plug boot and the tower unit when the plug boot is attached to the tower unit; and the rib is provided at a position corresponding to a radial direction axis that is different from the radial direction axis of the plug boot in which the air venting hole is provided.

* * * * *